US006120394A

United States Patent [19]

Kametani

[11] Patent Number: 6,120,394

[45] Date of Patent: Sep. 19, 2000

[54] MARKED GOLF BALL AND MANUFACTURING PROCESS THEREOF

[75] Inventor: Ryuhei Kametani, Osaka, Japan

[73] Assignee: Kametani Sangyo Kabushiki Kaisha, Osaka-Fu, Japan

[21] Appl. No.: 09/238,931

[22] Filed: Jan. 28, 1999

[30] Foreign Application Priority Data

Nov. 17, 1998 [JP] Japan ..... 10-326453

[51] Int. Cl.[7] ..... A63B 37/12; A63B 37/14

[52] U.S. Cl. ..... 473/378; 473/374; 40/327; 101/492

[58] Field of Search ..... 473/378, 375, 473/370, 374, 354, 380, 406, 365, 385, 379; 40/327; 101/483, 492

[56] References Cited

U.S. PATENT DOCUMENTS

| | | | |
|---|---|---|---|
| 3,753,565 | 8/1973 | Baker | 273/213 |
| 5,330,195 | 7/1994 | Gulick | 273/213 |
| 5,542,680 | 8/1996 | Proudfit et al. | 473/378 |
| 5,564,707 | 10/1996 | Dinh | 473/218 |
| 5,762,573 | 6/1998 | Kennedy, III et al. | 473/570 |
| 5,778,793 | 7/1998 | Mello et al. | 101/494 |
| 5,878,670 | 3/1999 | Yamaguchi | 101/492 |
| 5,885,173 | 3/1999 | Keller | 473/385 |

*Primary Examiner*—Lee Young
*Assistant Examiner*—Minh Trinh
*Attorney, Agent, or Firm*—Sughrue, Mion, Zinn, Macpeak & Seas, PLLC

[57] ABSTRACT

A marked golf ball is provided. The mark on the ball surface contains a holographic portion in a solid color portion of printing ink. The mark is printed on the ball surface by use of a transfer printing film. In a manufacturing process of the printing film, a desired shape is printed in ink on a cover layer, the ink portion is masked by a water-soluble layer, a thin metal layer is deposited all around, and then the water-soluble layer is washed off to remove the metal layer on the water-soluble layer and to leave the metal layer adjacent to the ink portion on the cover layer. The remaining portion of the metal layer turns to be the holographic portion due to a rough boundary between the cover layer. The mark has a novel appearance and makes the golf ball a quality, decorative, distinct and well discriminative value added product.

8 Claims, 4 Drawing Sheets

MARKED GOLF BALL AND MANUFACTURING PROCESS THEREOF

FIELD OF THE INVENTION

The present invention relates to a marked golf ball. More particularly, it relates to an improvement in an appearance of a golf ball having a mark thereon.

BACKGROUND OF THE INVENTION

In general, a sports use instrument is marked a pattern consisting of letters, numerals, a logotype, and the like. In case of a golf ball, it bears a mark on its surface presenting a trade name, a ball number, and so on. A golfer identifies his ball by the mark. These days, even an amateur golfer has his balls marked with his initial or his own original illustration. This makes an appearance of his ball distinguishing it from others and facilitates the identification of the ball.

Marking of golf balls has been achieved by use of printing ink. However, since printing inks exhibit only known colors, although a shape of the pattern, or mark, is unique, a visual feeling obtained at a glance of the ball does not vary so much. Thus, attempts to produce a diversified, distinct, and well discriminative value added golf ball have not succeeded greatly so far.

Consequently, it is an object of the present invention to provide a golf ball bearing a mark having a novel appearance superior in diversification, distinction and discrimination of the ball.

SUMMARY OF THE INVENTION

As the result of earnest studies and investigation to achieve the above object, the present inventor has succeeded in providing a golf ball having a mark superior in appearance, and thus, superior in diversification, distinction and discrimination of the ball.

According to the present invention, a mark on the golf ball surface comprises an ink portion and a metal foil portion. These portions constitute a desired pattern, or the mark. These portions are covered with a cover layer. Besides, a boundary between the cover layer and the metal foil portion of the mark is formed not smooth but rough by an emboss technique, for instance. Therefore, light coming to the metal foil portion through the cover layer diffracts due to a rough surface of the metal foil portion. Consequently, the metal foil portion exhibits not only a quality metallic luster but also a rainbow holographic appearance that printing inks can never offer. In other words, the metal foil portion turns to be a hologram portion.

On the other hand, the ink portion exhibits any desired color. Therefore, the mark is constituted by a combination of a plurality of portions having completely different visual effects from each other. The characteristic visual effects of both portions are enhanced synergistically. Thus, the mark and the golf ball bearing the mark become superior in appearance.

According to the present invention, the marked golf ball is manufactured by use of a transfer printing film. The manufacturing process of the marked golf ball begins with forming the cover layer on one side of a base film of the transfer printing film, followed by making a surface of the cover layer rough. Next, a desired shape is printed in ink having a desired color on the rough surface of the cover layer to form the ink portion. Hereupon, fine recesses of the rough surface of the cover layer are filled up with the ink. Therefore, a holographic effect as obtained in the hologram portion does not occur and the original color of the ink is well preserved in the ink portion.

Then, a water-soluble layer is formed on the ink portion. In this case, an excess of the water-soluble layer may be formed on the cover layer, but not on a part of the cover layer where the hologram portion will be located later.

Then, a metal foil layer is formed all around, i.e. on the water-soluble layer and on the above-mentioned part of the cover layer where both the ink portion and the water-soluble layer are not formed. Hereupon, two kinds of regions exist on the base film. One is a region that consists of a lamination of the cover layer, ink portion, water-soluble layer and metal foil layer, and the other a region that consists of a lamination of the cover layer and metal foil layer. In the latter region, a boundary between the cover layer and metal foil layer is rough due to the rough surface of the cover layer, whereby a holographic effect is obtained.

Therefore, such a state is now realized that the metal foil portion, or hologram portion, having the holographic effect and the ink portion having the desired color effect locate adjacent to each other on the cover layer, and thus, the mark consisting of a combination of these portions appears on the cover layer, but the metal foil layer is unnecessarily formed in the region where the ink portion locates.

Then, the water-soluble layer is removed by a water wash, whereby a portion of the metal foil layer formed on the water-soluble layer is removed simultaneously, and the unnecessary metal foil layer is removed from the region where the ink portion locates. On the other hand, a portion of the metal foil layer directly formed on the rough surface of the cover layer remains to be the hologram portion independently. Hereupon, the mark consisting of a combination of the ink portion and hologram portion is finally formed on the cover layer. Each portion locates adjacent to but is clearly isolated from other portion. Therefore, the characteristic visual effects of both portions are enhanced synergistically, and are not spoiled by each other. If the ink portion and hologram portion overlap each other entirely or even partially, the visual effects of both portions are shielded and decreased in the overlapping area. Consequently, according to the manufacturing process of the present invention, the excellent appearance of the mark and the golf ball is well maintained because the ink portion and hologram portion are clearly separated.

In addition, as stated above, fine recesses of the rough surface of the cover layer are filled up with ink, and a holographic effect does not occur in the ink portion. Therefore, the cover layer surface can be formed rough regardless of positions of the ink portion and hologram portion. The surface may be formed rough entirely, for instance. This helps the rough surface formation be easy and saves the manufacturing time and cost.

Furthermore, as stated above, the metal foil layer unnecessarily applied over the ink portion is removed later together with the water-soluble layer. Therefore, the metal foil layer can be applied all around regardless of positions of the ink portion and hologram portion. This helps formation of the metal foil layer and saves manufacturing time and cost as well.

Then, an adhesive layer is formed on the mark, i.e. on the ink portion and hologram portion to obtain a transfer printing film. The adhesive layer may be formed on the cover layer around or in the mark as well. In this case, fine recesses of the rough surface of the cover layer around or in the mark are filled up with an adhesive of the adhesive layer. Therefore, a holographic effect as obtained in the hologram portion does not occur and original transparency of the adhesive layer and cover layer is well preserved. Thus, although this lamination portion of the adhesive layer and cover layer is transferred to a golf ball surface together with the mark, the ball surface can be clearly observed through the lamination portion as if these layers were not on the ball surface.

Then, the mark is transfer printed to a golf ball surface using thus-obtained transfer printing film. For example, the printing film is pressed to a golf ball by a heated silicone pad, and then, the base film is removed.

Because the transferred mark is constituted by a combination of the ink portion and hologram portion having different visual effects from each other, a golf ball bearing the mark thereon possesses a novel appearance and becomes a diversified, distinct and well discriminative value added product.

BRIEF DESCRIPTION OF THE DRAWINGS

The above and other objects, features and advantages of the present invention will be apparent from the following detailed description of the best mode for carrying out the invention in conjunction with the accompanying drawings, in which.

BEST MODE FOR CARRYING OUT THE INVENTION

Figure 1:
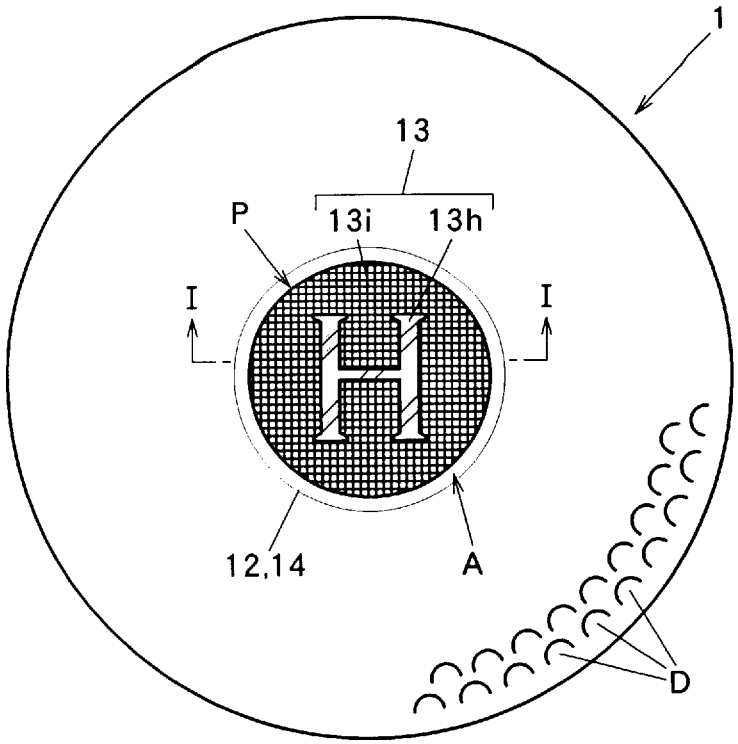
FIG. 1 is a front view of a marked golf ball exemplifying the present invention.

As shown in FIG. 1, a golf ball 1 of the present invention is marked a pattern P on its surface. The pattern P is constituted by a combination of a shape of circle and a letter of "H" presented in the circle. An area inside the circle, except an area of the letter "H", is printed solidly in black printing ink to define this black ink area as an ink portion 13*i*. The area of the letter "H" is printed with a thin metal foil exhibiting a metallic luster and rainbow holographic appearance to define this metal foil area as a hologram portion 13*h*.

Therefore, the pattern P consists of these two portions 13*i* and 13*h* having completely different characteristic visual effects from each other. In addition, these portions 13*i* and 13*h* are located adjacent to, but clearly separated from each other without overlapping. Hence, the characteristic visual effects of the black colored circle area 13*i* and the rainbow holographic letter area 13*h* are enhanced synergistically without being shielded or decreased by the other area.

Consequently, the golf ball 1 of the present invention possesses a novel excellent appearance, and can be served as a diversified, distinct and well discriminative value added commercial product.

Figure 2:
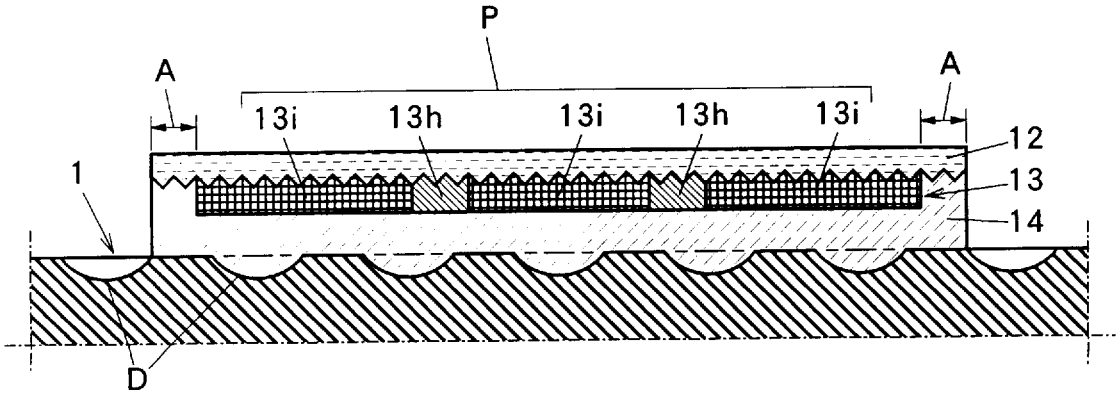
FIG. 2 is an enlarged sectional view, taken in the direction of the arrows I—I in FIG. 1, showing a layer composition of a marking portion on the golf ball.

As shown in FIG. 2, on the surface of golf ball 1 is disposed a lamination of a colorless transparent adhesive layer 14 directly sticking to the ball surface, a pattern layer 13 comprising the black ink portion 13*i* and holographic metal foil portion 13*h* located adjacent to each other to constitute the pattern P, and a colorless transparent cover layer 12 covering and sandwiching the pattern layer 13 with the adhesive layer 14. The cover layer 12 and the adhesive layer 14 exist beyond and around the pattern P, or the pattern layer 13, on the ball surface. This excess part of the layers 12 and 14 is accorded a reference character A as shown in FIGS. 1 and 2. The pattern P adheres well to a spherical and dimpled D . . . D surface of the golf ball 1.

A rough boundary between the cover layer 12 and pattern layer 13, and a boundary between the cover layer 12 and adhesive layer 14 in the excess part A are formed. In the pattern layer 13, the rough boundary is filled with the black ink of the ink portion 13*i* and with the metal of the hologram portion 13*h*. In the adhesive layer 14, the rough boundary is filled with the adhesive of the adhesive layer 14.

Therefore, in the hologram portion 13*h* of the pattern layer 13, a rainbow holographic appearance can be observed through the cover layer 12 due to a diffused reflection of light by the rough boundary, but in the ink portion 13*i*, such a holographic visual effect can not be obtained because the rough boundary is filled up with the black ink, and the original black color of the ink can be observed well without change or discoloration.

In addition, because the two different portions 13*i* and 13*h* are placed adjacent to each other without any room therebetween in the pattern layer 13, the pattern P constituted by a combination of these portions 13*i* and 13*h* has a superior appearance that the two different characteristic visual effects, i.e. the original black color effect of the black ink portion 13*i* and the rainbow holographic effect of the hologram portion 13*h*, are enhanced synergistically.

On the other hand, in the excess part A of the cover layer 12 and adhesive layer 14, a rainbow holographic visual effect as obtained in the hologram portion 13*h* can not be observed because the rough boundary between the layers 12 and 14 is filled up with the adhesive. Therefore, the original colorless transparency of these overlapping layers 12 and 14 is well maintained, and a white surface of the golf ball 1 can be clearly seen without change or discoloration in the excess part A. Consequently, the existence of the excess part A of the overlapping layers 12, 14 around the pattern P is not noticeable, and thus, an excellent contrast among the white color of the ball surface, black color of the ink portion 13*i* and metallic lustered holographic color of the hologram portion 13*h* is well preserved vividly.

Figure 3:
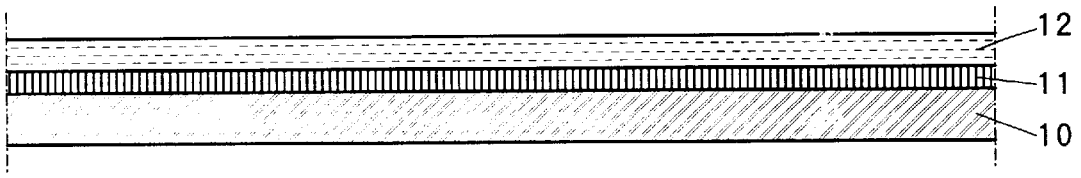
FIGS. 3 to 9 are enlarged sectional views, each showing a layer composition during the manufacturing process of the marked golf ball of the present invention step by step.

In a manufacturing process of the marked golf ball 1 as shown in FIG. 1 exemplifying the present invention, a resin solution is first applied on one side of a base film 10 to form a release layer 11, as shown in FIG. 3.

As the base film 10, a polyethyleneterephthalate (PET) film is preferably used from the viewpoint of heat-resistance and press-resistance during the pattern transfer operation to the golf ball 1. A thickness of the base film 10 is preferably 9 to 25 microns. In particular, when the thickness exceeds 25 microns, adhesion of the pattern P to the spherical and dimpled golf ball surface may be lowered.

As the resin usable herein for the release layer 11, any of known resins can be employed which have an adequate releasing character and have been commonly used in the transfer printing film manufacture.

Then, as shown in FIG. 3, a resin solution superior in transparency and heat-resistance is applied on the release layer 11 to form a cover layer 12. The resin preferably usable herein for the cover layer 12 includes, for example, an acrylic-urethane resin.

This cover layer 12 protects the pattern P transferred on the golf ball surface from dirt and discoloration. In addition, in case of the spherical golf ball 1, the cover layer 12 specifically cooperates with the adhesion layer 14 to prevent cracks in the ink portion 13*i* and metal foil portion 13*h* of the pattern layer 13 therebetween. As a result the excellent appearance of the pattern P can be realized satisfactorily and preserved.

Figure 4:
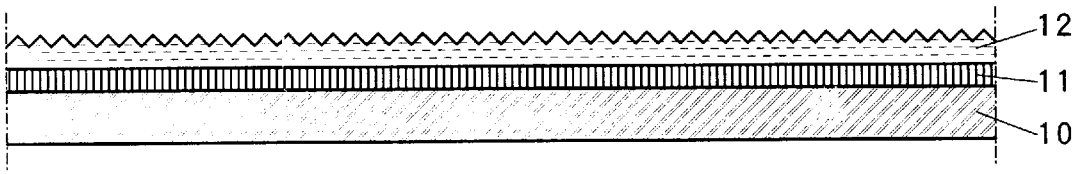

Then, as shown in FIG. 4, the cover layer 12 is embossed to form fine projections and recesses on its surface. The projections and recesses may be formed in as same size, depth and density as in conventional hologram film.

Figure 5:
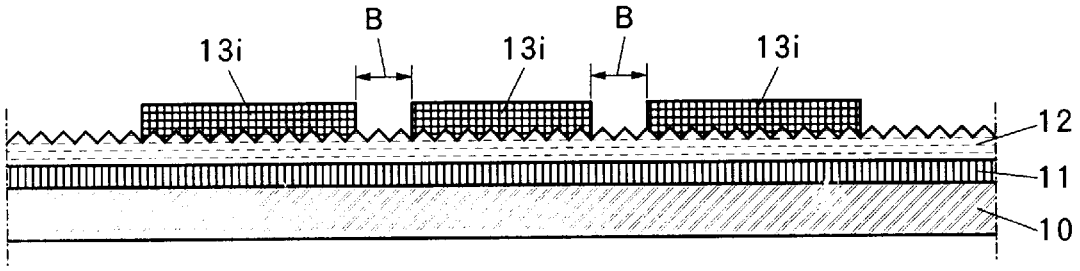

Next, as shown in FIG. 5, a shape of circle is printed in black printing ink on thus-obtained rough surface of the cover layer 12 to form the ink portion 13*i*. A gravure printing technique or screen printing technique can be used for applying the ink. The circle is printed solidly except an area B that shows the letter "H".

The printing ink usable herein for forming the ink portion 13*i*, may be any of known printing inks which have a desired color and have been commonly used in the transfer printing film manufacture.

Figure 6:
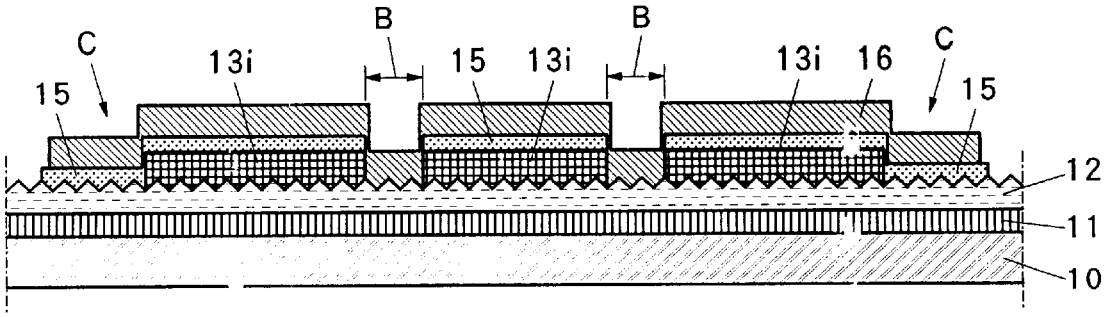

Then, as shown in FIG. 6, a water-soluble resin solution is applied on the ink portion 13*i* and on the cover layer 12 in an area C around the pattern P to form a water-soluble layer 15, but not on the cover layer 12 in the above-mentioned area B that shows the letter "H". A gravure printing technique or screen printing technique can be used for applying the resin solution. The resin usable herein for the water-soluble layer 15, may be any of known resins which can be dissolved in and removed by a sodium hydroxide solution, for instance. An example of such resin includes, for example, polyvinylalcohol.

Then, as shown in FIG. 6, a metal foil layer 16 is formed on the water-soluble layer 15 and on the cover layer 12 in the area B. As the metal usable herein for the metal foil layer 16, any of known metals can be employed which can be deposited by a vacuum evaporation technique. An example of such metal includes aluminum. Other known techniques such as a sputtering technique can be used for forming the metal foil layer 16 as well.

In case of aluminum, a thickness of the metal foil layer 16 is preferably 200 to 600 angstroms, more preferably 300 to 550 angstroms, and most preferably 350 to 450 angstroms. The water-soluble layer 15 with the metal foil layer 16 thereon having a thickness in the above-mentioned ranges can be easily removed by subsequent water wash.

Figure 7:
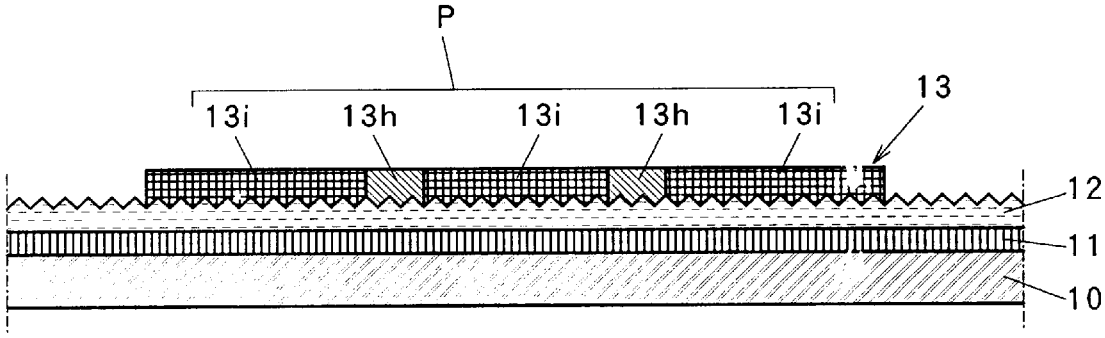

Then, thus-processed base film 10 is washed by a sodium hydroxide solution, whereby the water-soluble layer 15 is dissolved and removed together with the metal foil layer 16 thereon, as shown in FIG. 7. On the other hand, both the ink portion 13*i* showing the shape of circle and the metal foil layer 16 in the area B showing the letter "H" remain on the cover layer 12 separately from each other, whereby the remaining metal foil layer 16 in the area B turns to be a hologram portion 13*h*, and the original color of the ink portion 13*i* and the holographic appearance of the hologram portion 13*h* in the area B are well preserved, respectively. Hereupon, on the cover layer 12 is finally formed a pattern layer 13 consisting of a combination of the ink portion 13*i* and hologram portion 13*h* defining the pattern P.

Figure 8:
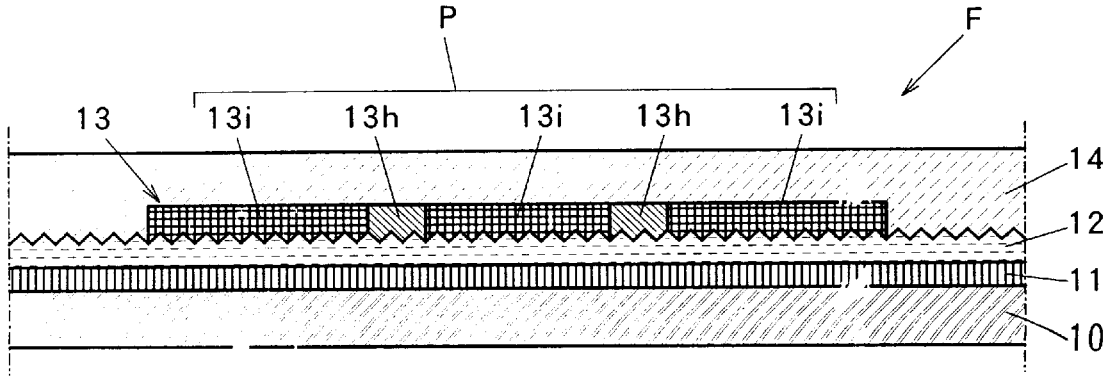

Then, a thermoplastic resin is coated on the pattern layer 13 comprising the remaining ink portion 13*i* and hologram portion 13*h* and on the cover layer 12 around the pattern layer 13 to form a adhesive layer 14. As a result a transfer printing film F is obtained which has a layer composition as shown in FIG. 8.

The thermoplastic resin usable herein for the adhesive layer 14, any of known resins which are which is superior in adhesion to the golf ball surface under a desired transfer condition and has an excellent transparency. An example of such resin includes a blend of vinylchloride-vinylacetate copolymer and acrylic resin, a blend of vinylchloride-vinylacetate copolymer, acrylic resin and polyester resin, and a blend of vinylchloride-vinylacetate copolymer, acrylic resin and ethylenevinylacetate resin.

The adhesive layer 14 preferably possesses as equal heat shrink index, heat-resistance and hardness as the cover layer 12 from the viewpoint of preventing cracks during the transfer operation in the pattern layer 13 disposed between the cover layer 12 and adhesive layer 14. An example of thickness of the adhesive layer 14 is preferably 1 to 2 microns when a thickness of the cover layer 12 is 0.8 to 1.5 microns.

Figure 9:
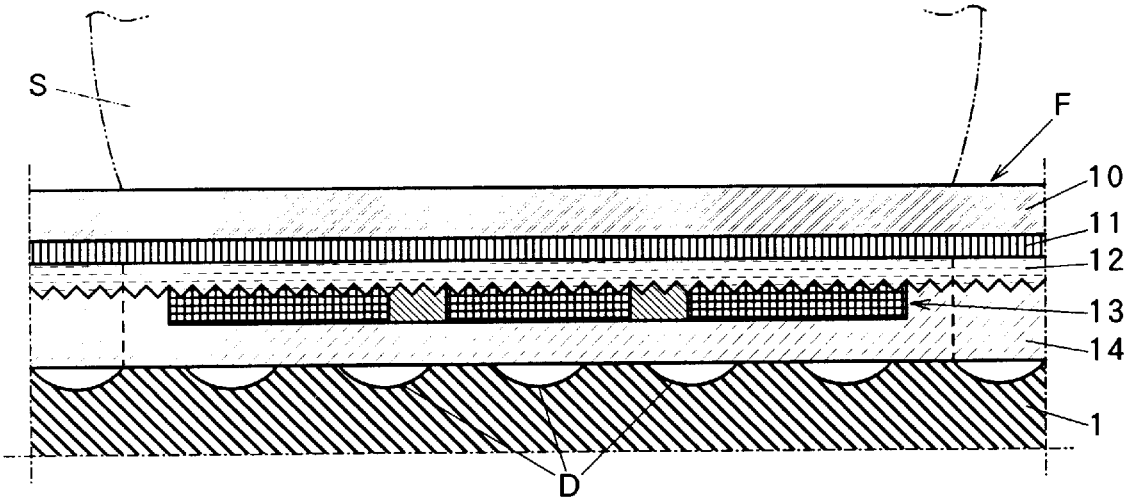

Then, as shown in FIG. 9, the pattern P is transfer printed on the surface of the golf ball 1 with using thus-obtained transfer printing film F by means of, for example, a hot stamping technique. That is, the transfer printing film F is positioned so that the adhesive layer 14 thereof contacts the surface of the golf ball 1, and the printing film F is pressed to the ball 1 by a heated silicone pad S. The transfer condition depends on a kind of adhesive of the adhesive layer 14, for instance, and any of known conditions can be employed which have been used in transfer printing with conventional transfer printing film. In particular, a transfer temperature is preferably 120 to 150° C. When the transfer temperature exceeds 150° C., heat damage such as a distortion of golf ball or dimples D . . . D may occur.

Finally, the base film 10 is removed from the ball surface, whereby the adhesive layer 14, pattern layer 13 and cover layer 12 are transferred to the spherical and dimpled D . . . D surface of the golf ball 1 without problems such as heat damage of the ball. Also, the release layer 11 between the base film 10 and cover layer 12 helps these transferring layers 12, 13 and 14 be smoothly transferred to the ball 1, whereby an excellent transferability of the pattern P is achieved and the pattern P is free from chipping.

Figure 10:
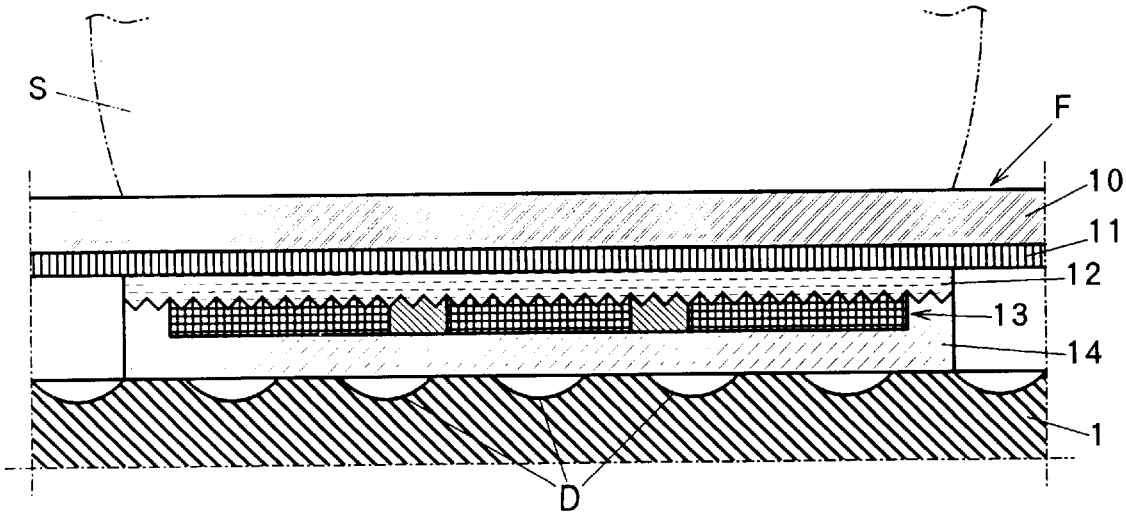
FIG. 10 is an enlarged sectional view, showing a layer composition of a transfer printing film in the other mode of the invention.

Hereupon, the adhesive layer 14 and cover layer 12 are heated in a pressing range of the heated pad S, and thus, these layers 12, 14 and the pattern layer 13 between the layers 12, 14 are transferred to the surface of the golf ball 1 in the above-mentioned range, as shown by the broken lines in FIG. 9. Alternatively, as shown in FIG. 10, in the manufacturing process of the printing film F, as far as the cover layer 12 and adhesive layer 14 can cover and sandwich the pattern layer 13, these layers 12, 14 may be formed partially on the base film 10, or release layer 11.

As stated above, the pattern P constituted by a combination of the ink portion 13*i* exhibiting a desired color appearance and metal foil portion 13*h* exhibiting a holographic metal luster appearance can be marked on the golf ball 1, without cracking or chipping therein, at only one printing step. Moreover, because the ink portion 13*i* and hologram portion 13*h* having different visual effects are located adjacent to, but clearly separated from each other, without overlapping, an excellent appearance of the pattern P is enhanced synergistically, and the golf ball 1 marked with this pattern P can be a diversified, distinct and well discriminative value added commercial product.

Alternatively, a plurality of printing inks having various colors may be used to form the ink portion 13*i*, whereby a pattern possessing a holographic portion 13*h* can be multicolor printed.

Optionally, a clear topcoat may be further applied over the cover layer 12.

The mark is applicable to any kind of golf balls including one-piece ball, two-piece ball, multi-piece ball greater than three-piece ball, and thread-wound ball.

Furthermore, it may be a choice not to emboss the cover layer 12. In this case, although the metal foil portion 13*h* does not exhibit a holographic appearance, it does exhibit a quality metallic luster that printing inks can never offer either. Thus, the pattern, or mark, or golf ball possesses an excellent appearance that the completely different visual effects, i.e. a metallic luster and an ink color, are enhanced synergistically without spoiling each other.

EXAMPLE

Example of the present invention is given below by way of illustration and not by way of limitation.

An acrylic resin was applied on a surface of a polyethylene-terephthalate film having a thickness of 25 microns by means of a gravure printing technique to form a release layer. Then, an acrylic-urethane resin was applied on the release layer by means of a gravure printing technique to form a cover layer having a thickness of 1.5 microns. Then, a whole surface of the cover layer was embossed with fine projections and recesses to be a rough surface.

Then, a shape of circle having a diameter of 1 cm was printed in black printing ink on thus-embossed cover layer surface to form an ink portion. The circle was printed solidly except an area showing a numeral "1" inside the circle by means of a screen printing technique. Then, a silicon oxide added polyvinylalcohol was applied by means of a screen printing technique to form a water-soluble layer. The polyvinylalcohol was applied on the ink portion and on the cover layer around the circle, but not on the above-mentioned area showing the numeral "1" inside the circle.

Then, aluminum was deposited in a thin layer having a thickness of 450 angstroms by means of a vacuum evaporation technique to form a metal foil layer. The metal foil layer was formed on the water-soluble layer and on the cover layer including the above-mentioned area showing the numeral "1". Then, thus-processed film was washed by a sodium hydroxide solution to dissolve and remove the water-soluble layer from the film together with the aluminum thin layer thereon. On the other hand, in the area showing the numeral "1" where the polyvinylalcohol had not been applied, the aluminum thin layer has remained, and thus, a hologram portion was obtained.

Next, a blend of vinylchloride-vinylacetate copolymer and acrylic resin was applied over the ink portion and hologram portion by means of a gravure printing technique to form an adhesive layer having a thickness of 2 microns, whereby a transfer printing film was obtained which presented a pattern that the holographic metallic lustered numeral "1" was shown in the black colored circle.

Then, the pattern was transfer printed on an ionomer resin surface of plasma treated two-piece golf ball by use of thus-obtained transfer printing film by means of a hot stamping technique. A transfer temperature was 120° C. and a transfer period of time was 1 second.

Finally, the appearance of the ball was evaluated by a visual observation. The pattern was printed on the spherical and dimpled golf ball surface satisfactorily without chipping or cracking. The numeral "1" exhibited a rainbow holographic appearance in the midst of the black colored circle, offering a fine contrast thereof. In the area around the pattern where the colorless transparent cover layer and adhesive layer must have been transferred on the ball surface, no holographic effect was observed so that the ball surface was clearly seen without any change or discoloration. Thus, the contrast between the white color of the ball surface and black color of the pattern comprising a holographic numeral portion offered a splendid novel appearance, and the golf ball was a diversified, distinct and discriminative value added product.

There have been described a golf ball having a mark constituted by a combination of ink color portion and metal holographic portion, and a process for manufacturing the ball. The ink portion exhibits a desired color effect and the metal portion exhibits a rainbow holographic effect. These effects are of completely different nature and different kind from each other. Thus, the ball so marked is superior in appearance to conventional balls marked with printing inks only. The marked golf ball of the present invention would be a diversified, distinct, quality, decorative, value added product that can be easily identified or discriminated from other balls. In particular, considering a golf is an outdoor sport, merits gained by the golf ball of the present invention, which bears the mark that has holographic portions to shine rainbow metallic luster under the sun light, are of great significance from the viewpoint of product diversification. In addition, the ink portion and the hologram portion are located close to, but separately from each other. Thus, each characteristic visual effect is enhanced, but not spoiled by the other effect. Furthermore, the mark having both hologram portions exhibiting holographic appearance and ink portions exhibiting desired color appearance can be printed on the golf ball surface in a single printing step. Thus, the manufacturing process of the marked golf ball of the invention is shortened and valuable from a cost point of view. Moreover, in an area not constituting the pattern where only the adhesive layer and cover layer exist, a holographic effect does not occur and these layers are not noticeable. Thus, an original appearance of the ball surface can be seen without change or discoloration, and a vivid contrast between the pattern and the golf ball surface is well performed.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A process for manufacturing a golf ball having a mark thereon, said mark comprising an ink portion and a metal foil portion covered with a cover layer, and a boundary between said cover layer and metal foil portion being rough, said process comprising the steps of:

(A) forming a cover layer on a base film;

(B) making a surface of said cover layer rough;

(C) printing a desired shape using ink of a desired color on said rough surface of the cover layer to define a portion of said rough surface where the ink is applied to defining an ink portion;

(D) forming a water-soluble layer at least on said ink portion, except for a part of the rough surface of the cover layer which constitutes the mark together with said ink portion;

(E) forming a metal foil layer on said water-soluble layer and on said part of the rough surface of the cover layer;

(F) removing the water-soluble layer with said metal foil layer on the water-soluble layer to thereby define said part of the rough surface of the cover layer where said metal foil layer has remained as a metal foil portion;

(G) forming an adhesive layer at least on said metal foil portion and said ink portion constituting the mark to obtain a transfer printing film; and (H) transfer printing the mark to a golf ball using said transfer printing film.

2. A process as set forth in claim 1, in which a release layer is formed on the base film and the cover layer is formed on said release layer.

3. A process as set forth in claim 1, wherein said base film comprises polyethyleneterephthalate.

4. A process as set forth in claim 1, wherein said base film has a thickness in the range of 9 to 25 microns.

5. A process as set forth in claim 1, wherein said water-soluble layer comprises polyvinylalcohol.

6. A process as set forth in claim 1, wherein said metal foil layer comprises aluminum having a thickness in the range of 200 to 600 angstroms.

7. A process as set forth in claim 1, wherein the step of removing the water-soluble layer comprises washing with a sodium hydroxide solution.

8. A process as set forth in claim 1, wherein said step of transferring comprises heating and pressing said adhesive layer and said cover layer.

* * * * *